US011090517B2

(12) United States Patent
Hung et al.

(10) Patent No.: US 11,090,517 B2
(45) Date of Patent: Aug. 17, 2021

(54) FALL PROTECTION DEVICE

(71) Applicant: YOKE INDUSTRIAL CORP., Taichung (TW)

(72) Inventors: Wei-Chieh Hung, Taichung (TW); Jyu-Yi Wang, Changhua (TW); Eason Sun, Taichung (TW)

(73) Assignee: YOKE INDUSTRIAL CORP., Taichung (TW)

( * ) Notice: Subject to any disclaimer, the term of this patent is extended or adjusted under 35 U.S.C. 154(b) by 302 days.

(21) Appl. No.: 16/135,321

(22) Filed: Sep. 19, 2018

(65) Prior Publication Data

US 2019/0083827 A1 Mar. 21, 2019

(30) Foreign Application Priority Data

Sep. 20, 2017 (TW) ..... 106132319

(51) Int. Cl.
*A62B 1/10* (2006.01)
*A62B 35/00* (2006.01)

(52) U.S. Cl.
CPC ..... *A62B 35/0093* (2013.01); *A62B 1/10* (2013.01)

(58) Field of Classification Search
CPC ..... A62B 35/0093; A62B 1/10
See application file for complete search history.

(56) References Cited

U.S. PATENT DOCUMENTS 8,490,750 B2 * 7/2013 Balquist ..... A62B 35/0093 182/231
9,861,841 B1 * 1/2018 Hung ..... A62B 35/0093
10,351,385 B2 * 7/2019 Choate ..... B65H 75/4428
2010/0252366 A1 * 10/2010 Jones ..... A62B 35/04 182/232
2012/0031701 A1 * 2/2012 Jones ..... A62B 35/0093 182/5

(Continued)

FOREIGN PATENT DOCUMENTS

CN 204601426 U 9/2015
TW M529524 U 10/2016

(Continued)

OTHER PUBLICATIONS

Examination Report for TW107132597, dated May 10, 2019, Total of 2 pages.

(Continued)

*Primary Examiner* — Alvin C Chin-Shue
(74) *Attorney, Agent, or Firm* — Lynette Wylie; Apex Juris, Pllc

(57) ABSTRACT

A fall protection device includes a frame, a rolling member, a safety belt, a braking plate, a braking part, and a restoring spring. The frame has a first side plate. An outer side surface of the first side plate is provided with a blocking part. A rolling member is rotatably disposed on the frame. A safety belt is wound around the rolling member. A braking plate is engaged to the rolling member and has an inner side surface, which faces the outer side surface. The braking part is pivotally disposed on the braking plate and is located between the inner side surface and the outer side surface, whereby to ensure that the braking part at a braking position could be abutting against the blocking part.

8 Claims, 12 Drawing Sheets

(56) References Cited

U.S. PATENT DOCUMENTS

| | | | | |
|---|---|---|---|---|
| 2012/0118670 | A1* | 5/2012 | Olson | A62B 1/10 182/232 |
| 2013/0105247 | A1 | 5/2013 | Casebolt | |
| 2013/0277631 | A1* | 10/2013 | Luntz | B66D 3/046 254/391 |
| 2014/0251731 | A1* | 9/2014 | Jones | A62B 35/04 182/231 |
| 2016/0367844 | A1 | 12/2016 | Yang | |
| 2017/0252591 | A1* | 9/2017 | Hetrich | A62B 1/08 |
| 2018/0147425 | A1* | 5/2018 | Su | A62B 35/0093 |

FOREIGN PATENT DOCUMENTS

| | | | |
|---|---|---|---|
| TW | M529525 | U | 10/2016 |
| TW | M547398 | U | 8/2017 |
| TW | M547399 | U | 8/2017 |
| TW | M573394 | U | 1/2019 |

OTHER PUBLICATIONS

Search Report for TW107132597, dated May 10, 2019, Total of 1 page.
English Abstract for CN204601426, Total of 1 page.
English Abstract for TWM547398, Total of 1 page.
English Abstract of corresponding document EP3459600 for TWM547398, Total of 1 page.
English Abstract for TWM529525, Total of 1 page.
English Abstract for TWM547399, Total of 1 page.
European Search Report for 18195420.7, dated Feb. 18, 2019, Total of 8 pages.
English Abstract for TWM529524, Total of 1 page.

* cited by examiner

FALL PROTECTION DEVICE

BACKGROUND OF THE INVENTION

1. Technical Field

The present invention is related to a fall protection device, and more particularly to a fall protection which is adapted in an elevated working place.

2. Description of Related Art

When working at an elevated working place, a user usually wears a fall protection device including a safety belt. The fall protection device is fixed on a support, and the safety belt is fastened to the user to prevent the user from falling continuously, whereby to ensure the user's security.

As shown in FIG. 1, a fall protection device 1 includes a housing 10, a frame 12, a rolling member 14, a safety belt 16, a winding device 18, a braking plate 20, and two braking blocks 22, wherein the rolling member 14, the safety belt 16, the winding device 18, the braking plate 20, and the two braking blocks 22 are located in the housing 10, and the housing 10 is formed by a pair of half housings 102, which could be engaged to each other. The frame 12 has a first side plate 122 and a second side plate 124 facing to the first side plate 122. The rolling member 14 is rotatably disposed between the first side plate 122 and the second side plate 124. A blocking block 122*a* is disposed on the first side plate 122. The safety belt 16 is wound around the rolling member 14. The winding device 18 is disposed on an outer side of the second side plate 124 and includes a spiral spring 182 connected to the rolling member 14, in order to provide a winding force to the safety belt 16. The braking plate 20 located at an outer side of the first side plate 122 is engaged to the rolling member 14 and could be driven to rotate by the rolling member 14. The braking plate 20 has an outer side surface 202 back to the first side plate 122. The braking block 22 is pivotally disposed on a pivot 202*a* of the outer side surface 202 of the braking plate 20 and is between the housing 10 and the first side plate 122. The braking block 22 is pivoted from a non-braking position to a braking position, for a centrifugal force is generated while the rolling braking plate 20 is rolling, whereby the braking block 22 is engaged to the blocking block 122*a* to restrict the rotation of the rolling member 14.

Referring to FIG. 2, when the user falls accidentally, in usual condition, the braking block 22 would be pivoted outward to the braking position to allow the blocking portion 222 of the braking block 22 abutting against the blocking block 122*a* of the first side plate 122, so the quick-locking effect that stops rolling the rolling member 14 would work to prevent the user from falling continuously.

However, most of the places where need to use the fall protection device 1 is full with dust quite often, and the dust is commonly attached to a pivoting part of the braking block 22 so that the braking block 22 would be fixed. The braking block 22 could not pivot outward in need and results in losing function of the quick-lock effect. Therefore, the pivoting part of the braking block 22 and the braking plate 20 would design in a loose manner as being engaged together to prevent the braking block 22 from being fixed even due to the small amount of dust.

However, the loose manner could allow the braking block 22 to possibly pivot backward the outer side surface 202 of the braking plate 20 (shown in FIG. 3). In this time, if due to factors such as assembly tolerance that results a space between the housing 10 and the outer side surface 202 of the braking plate 20 is wide, it would cause the blocking portion 222 of the braking block 22 and the blocking block 122*a* being disengaged to each other and losing the quick-locking effect.

Besides, Taiwanese patent No. M529524 disclosed a fall protection device. The fall protection device takes advantage of a decelerating member, which is provided on a shaft, to cooperate with an inner peripheral surface of the rolling drum and takes advantage of a friction force, which is produced by a rub between the friction surface of the decelerating member and the inner peripheral surface of the rolling drum, to slow down the revolution of the rolling drum and to cushion the speed of the safety belt, which is pulled out. However, the shaft is fixed on a frame, and an end of a spiral spring is fixed on the shaft, while another end is fixed on a side cover, as the rolling drum rotates against the decelerating member to produce a rubbing rotation, the side cover would still rotate continuously, so that the spiral spring would be overstretched, and would be broken due to elastic fatigue. Hence, the spiral spring loses its function and could not be used anymore.

BRIEF SUMMARY OF THE INVENTION

In view of the above, the purpose of the present invention is to provide a fall protection device, which could effectively increase the reliability of the quick-locking function.

The other purpose of the present invention is to provide a fall protection device, which would not be broken by being overstretched after the quick-locking function.

The present invention provides a fall protection device including a frame, a rolling member, a safety belt, a braking plate, a braking part, and a restoring spring, wherein the frame includes a first side plate and a second side plate, which is oriented to the first side plate. The first side plate has an outer side surface, which is oriented away from the second side plate; the outer side surface is provided with a blocking part. The rolling member is rotatably disposed between the first side plate and the second side plate and includes a shaft and a rolling drum, wherein the rolling drum is provided on the shaft. The safety belt is wound around the rolling member and is located between the first side plate and the second side plate, wherein the safety belt is pulled and forces the rolling member to rotate. The braking plate is engaged to the rolling member and includes an inner side surface, which faces the outer side surface of the first side plate, wherein the braking plate coaxially rotates with the shaft. The braking part is pivotally disposed on the inner side surface of the braking plate and is located between the inner side surface of the braking plate and the outer side surface of the first side plate. The braking part has a blocking portion, and the blocking portion of the braking part is pivoted out to a braking position from a non-braking position to attach the blocking part due to a centrifugal force produced by the rolling braking plate to strict the rotation of the rolling member. The restoring spring is connected between the braking part and the braking plate to move toward the non-braking position.

In an embodiment, the inner side surface of the braking plate is provided with a pivot, and the braking part has a pivoting hole fitted around the pivot. A width of the pivot is less than a width of the pivoting hole.

In an embodiment, the inner side surface of the braking plate is provided with a fixing pillar; An end of the restoring spring is connected to the braking part and is located beside the blocking portion, while another end includes a ring fitted around the fixing pillar.

In an embodiment, the inner side surface has a depression, and the restoring spring has a body part, wherein a portion of the body part protrudes into the depression.

In an embodiment, the inner side surface has a surface, and the depression is formed by recessed the surface; an end of the fixing pillar is connected to a depression-surface of the depression; the ring of the restoring spring is located between the surface and the depression-surface.

In an embodiment, when the braking part is at the non-braking position, the restoring spring is located within an orthographic range of the depression.

In an embodiment, the first side plate of the frame has a perforation; the inner side surface of the braking plate is provided with a protruding portion, wherein the protruding portion includes a first part and a second part connected with the first part. The first part passes through the perforation of the first side plate and is connected to the rolling member. A width of the second part is gradually expanding from the first part to the inner side surface.

In an embodiment, the braking part has a propped portion, wherein the propped portion and the blocking portion are respectively located at two sides, which are opposite to each other, of the pivoting hole. The propped portion follows the rolling braking plate to move along a moving pathway. The blocking part is located at the moving pathway of the propped portion. When the propped portion passes by the blocking part and is propped by the blocking part, forces the braking part to be pivoted.

In an embodiment, the braking plate has an outer circumference, and an edge of the propped portion is oriented away from the direction, which is toward the pivoting hole, and protrudes out of the outer circumference. When the propped portion passes by the blocking part, the edge passes and is abutting against the blocking part.

The present invention provides a fall protection device, which is adapted to be connected to a safety belt, including a frame, a rolling member, a decelerating member, a braking plate, a braking part, a restoring spring, a cover body, and a spiral spring, wherein the frame has a first side plate and a second side plate, and the first side plate is provided with a blocking part. The rolling member is disposed between the first side plate and the second side plate and includes a shaft and a rolling drum, wherein the rolling drum is adapted to be wound around by the safety belt, and the rolling drum has an inner peripheral surface. The decelerating member is fitted around the shaft and is and located between the shaft and the rolling drum, wherein an outer peripheral of the decelerating member includes at least one friction surface, which is in contact with the inner peripheral surface. The braking plate, which is connected to the rolling member, includes an inner side surface, which faces the first side plate, and the braking plate, the shaft, and the decelerating member rotate coaxially. The braking part, which is pivotally disposed on the inner side surface of the braking plate, has a blocking portion, wherein the blocking portion of the braking part is pivoted out to a braking position from a non-braking position to attach the blocking part due to a centrifugal force, which is produced by the rolling braking plate, to strict the rotation of the rolling member. The restoring spring is connected between the braking part and the braking plate and adapted to force the braking part toward the non-braking position. The cover body is connected with the second side plate, and the spiral spring, which is disposed in the cover body, includes an inner end and an outer end, wherein the inner end is fixed on the shaft, and the outer end is fixed on the cover body.

In an embodiment, the braking plate has an axial hole and is adapted to be passed into by an end of the shaft, so that the shaft and the braking plate rotate co-axially and synchronously In an embodiment, the shaft, the braking plate, and the decelerating member rotate synchronously, and when the braking part is pivoted out at the braking position and attaches to the blocking part, the shaft, the braking plate, and the decelerating member are fixed.

The advantage of the present invention is that with the first side plate and the braking plate to limit the position of the braking part could ensure that as the braking part is at the braking position, the blocking portion could be abutting against the blocking part, instead of missing and failing to be abutting against the blocking part due to the braking part pivoting backward that happened in the conventional fall protection device, so that effectively increase the reliability of the quick-locking function. Moreover, with the design of co-axial rolling of the shaft, the decelerating member, and the braking plate. When the fall protection device is locked suddenly and the rolling drum, which is wound around by the safety belt, and the decelerating member produce a rolling friction to cushion the speed, the shaft and the cover body, which are respectively connected to the inner and outer end of the spiral spring, are fixed, so that the spiral spring would not be overstretched by the force and to be elastically fatigued or broken.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
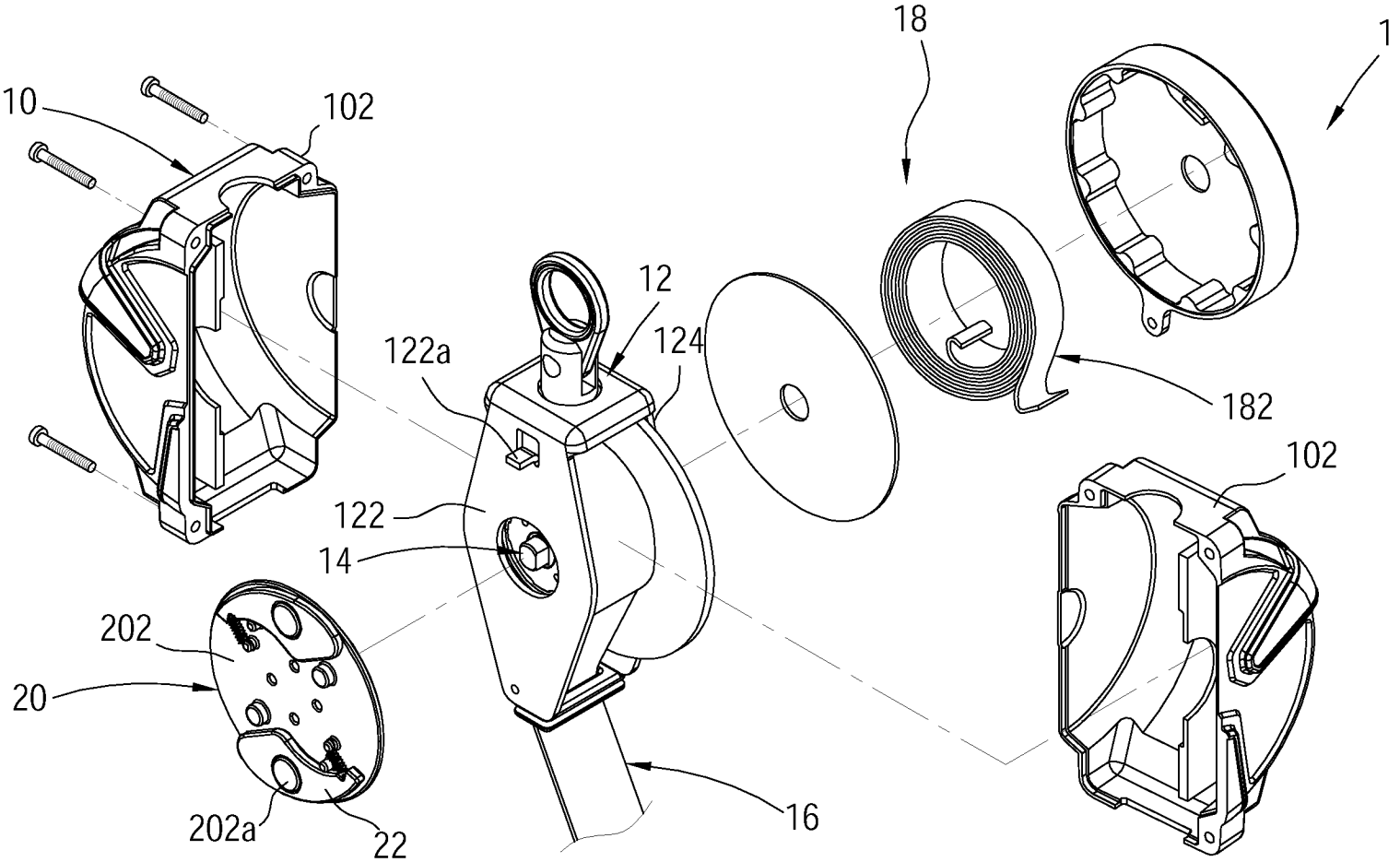
FIG. 1 is an exploded view of the conventional fall protection device.
Figure 3:
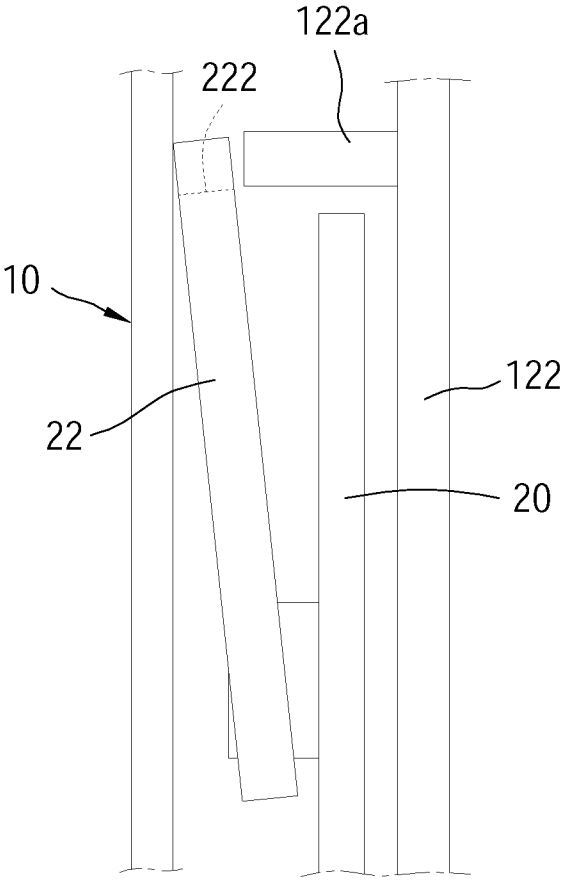
FIG. 3 is a schematic diagram disclosing that the blocking portion of the braking part is deviated from the swing in its normal way and could not be abutting against the blocking part.
Figure 2:
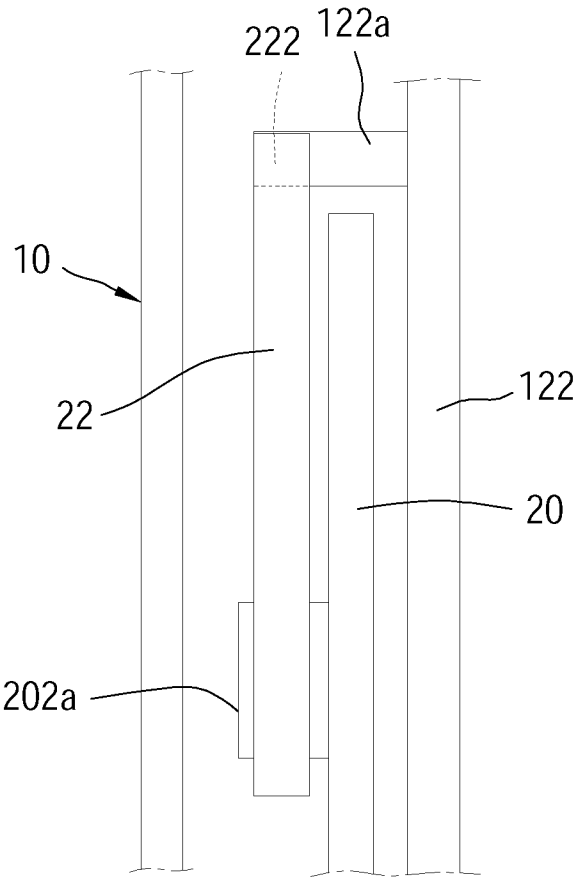
FIG. 2 is a schematic diagram disclosing that the blocking portion of the braking part is abutting against the blocking part.
Figure 4:
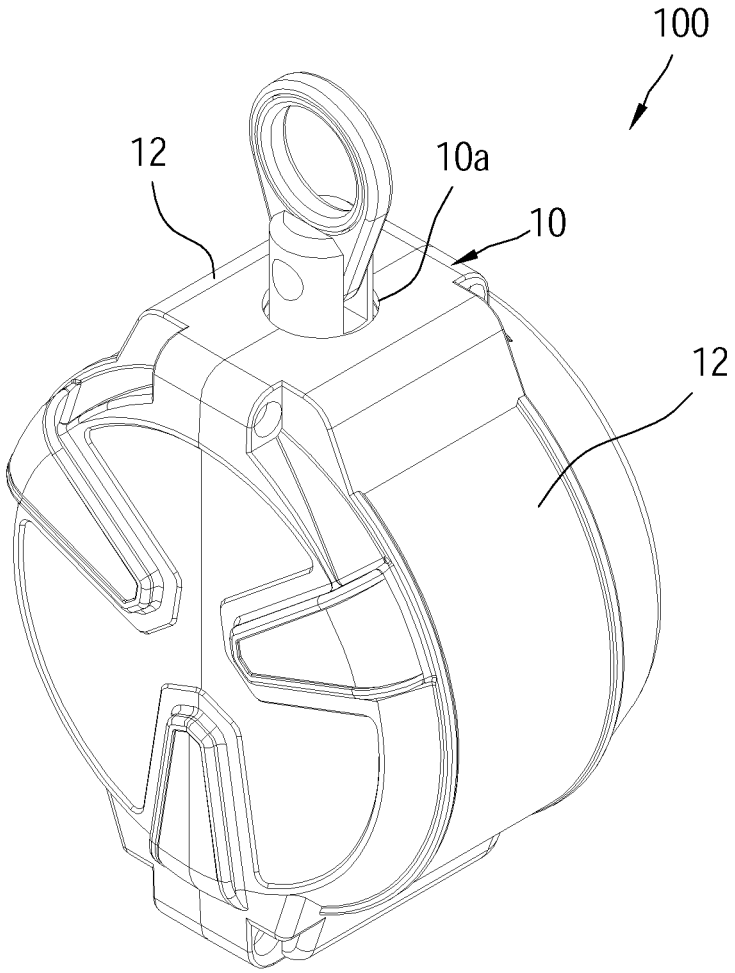
FIG. 4 is a perspective view of the fall protection device of an embodiment.

The invention will be described more fully hereinafter with reference to the accompanying drawings. As shown in FIG. 4 to FIG. 9, it is an embodiment of the fall protection device 100 of the present invention. The fall protection device 100 includes a housing 10, a frame 14, a rolling member 24, a safety belt 26, a cover body 28, a spiral spring 30, a braking plate 32, at least one braking part 40, and at least one restoring spring 42, wherein the frame 14, the rolling member 24, the safety belt 26, the cover body 28, the spiral spring 30, the braking plate 32, the at least one braking part 40, and the at least one restoring spring 42 are all located in the housing 10.

The housing 10 is formed by engaging a pair of housing bodies 12 together. Each of the housing bodies 12 has a first receiving room 12*a*, a second receiving room 12*b*, which is relatively separated from the first receiving room 12*a*, and an opening 12*c* respectively. As being engaged, the pair of housing bodies 12 are correspondingly connected together through the opening 12*c*. The housing 10 has a top opening 10*a* and a bottom opening (not shown).

The frame 14 includes a frame body 16 and a hanging ring 22 engaged on the top of the frame body 16, wherein the frame body 16 has a first side plate 18 and a second side plate 20, which face to each other. The first side plate 18 is received in the first receiving room 12*a* of each of the housing bodies 12. While the second side plate 20 is received in the second receiving room 12*b* of each of the housing bodies 12. The first side plate 18 has an outer side surface 182, which is oriented away from the second side plate 20. The outer side surface 182 is provided with at least one blocking part 182*a*. In the current embodiment, the blocking part 182*a* includes three blocking parts 182*a*. The first side plate 18 has a perforation 18*a*. The hanging ring 22 protrudes through the top opening 10*a* of the housing 10.

The rolling member 24 is rotatably disposed between the first side plate 18 and the second side plate 20 of the frame body 16. The rolling member 24 includes a shaft 242 and a rolling drum 244, wherein two ends of the shaft 242 pass through the perforation 18*a* of the first side plate 18 of the frame 14 and the second side plate 20 of the frame 14 respectively. The rolling drum 244 is disposed on the shaft 242 and rotates coaxially along with the shaft 242. A part of the rolling drum 244 is shown inside of the perforation 18*a*.

The safety belt 26 is wound around on the rolling member 24 and is located between the first side plate 18 and the second side plate 20. More specifically, an end of the safety belt 26 is connected to the rolling drum 244 and is wound around on the rolling drum 244. While another end extends through the opening on the bottom of the housing 10. The safety belt 26 is pulled to urge rotation of the rolling drum 244 and the shaft 242.

The cover body 28 is located in the second receiving room 12*b* of two housing bodies 12 and is connected to the second side plate 20 of the frame 14. The cover body 28 includes a first cover portion 282 and a second cover portion 284. The spiral spring 30 is provided between the first cover portion 282 and the second cover portion 284, wherein the spiral spring 30 has an inner end 30*a* and an outer end 30*b*. The inner end 30 of the spiral spring 30 is connected with the rolling member 24, while the outer end 30*b* thereof is connected with the cover body 28.

In the current embodiment, an edge of the second cover portion 284 has a perforation 285 adapted to be passed through by a locking member 200 (e.g. a bolt), and the locking member 200 is screwed in a corresponding positioning hole 20*a* on the second side plate 20 to force the cover body 28 to be fixed on the second side plate 20.

Additionally, in the current embodiment, an end of the shaft 242, which is oriented away from the braking plate 32, is provided with a connecting groove (not shown). The connecting groove is adapted to receive and be fixed with the inner end 30*a* of the spiral spring 30, while the outer end 30*b* of the spiral spring 30 is wedged and fixed on the second cover portion 284. Therefore, the spiral spring 30 would be stretched by the safety belt 26, which is being pulled, and would form a resilience (or called elasticity) to roll back to its usual form. Besides, when a user, who is attached by the safety belt 26, approaches the fall protection device 100, a force to pull the safety belt 26 is weak and is weaker than the elasticity of the spiral spring 30, the spiral spring 30 would return and roll back due to its recovering elasticity, so that allows the safety belt 26 to be wound around and be received by the rolling drum 244 as original form.

The braking plate 32 is engaged to the rolling member 24 and has an inner side surface 322 facing the outer side surface 182 of the first side plate 18. The braking plate 32 rotates coaxially along with the rolling member 24. In the current embodiment, the braking plate 32 is a disc in shape, and a central portion of the inner side surface 322 protrudes and forms a protruding portion 34, wherein the protruding portion 34 includes a first part 342 and a second part 344 connected to the first part 342. The diameter of the first part 342 is equal to the diameter of the perforation 18*a* of the first side plate 18, and the first part 342 passes through the perforation 18*a* thereof to be engaged to the rolling drum 244 of the rolling member 24. The first part 342 has an axial hole 342*a*, which is adapted to be fitted around the shaft 242, and the inner axial hole 342*a* is provided with at least one positioning surface 342*b* adapted to be wedged with another end of the shaft 242, so that the braking plate 32 could rotate coaxially along with the shaft 242. For example, in the current embodiment, the inner axial hole 342*a* has two positioning surfaces 342*b*, which are included by the at least one positioning surface 342*b* and face to each other, while another end of the shaft 242 has two positioning surfaces deviating from each other. After the shaft 242 is passed into the axial hole 342*a*, the two positioning surfaces of the shaft 242 would attach the two positioning surface 342*b* respectively, so that the braking plate 32 rotates coaxially and synchronically along with the shaft 242. The second part 344 is cone in shape, and the width of the second part 344 is gradually expanding from the first part 342 to the inner side surface 322. In this way, it could increase the strength of the braking plate 32 and it could minimize an interference between the rotating braking plate 32 and the first side plate 18. Moreover, the inner side surface 322 of the braking plate 32 is provided with at least one pivot 36 and at least one fixing pillar 38. In the current embodiment, the at least one pivot 36 includes two pivots 36, and the at least one fixing pillar 38 includes two fixing pillars 38, wherein each of the two pivots 36 and each of the two fixing pillars 38 are located at a side and an opposite side of the protruding portion 34 respectively.

The inner side surface 322 of the braking plate 32 has a surface 324, wherein the surface 324 is recessed and forms at least one depression 326. In the current embodiment, the at least one depression 326 includes two depressions 326. An end of each of two fixing pillars 38 is connected to the depression-surface 326*a* of each of two depressions 326 and is extended out of each of the depressions 326.

Figure 10:
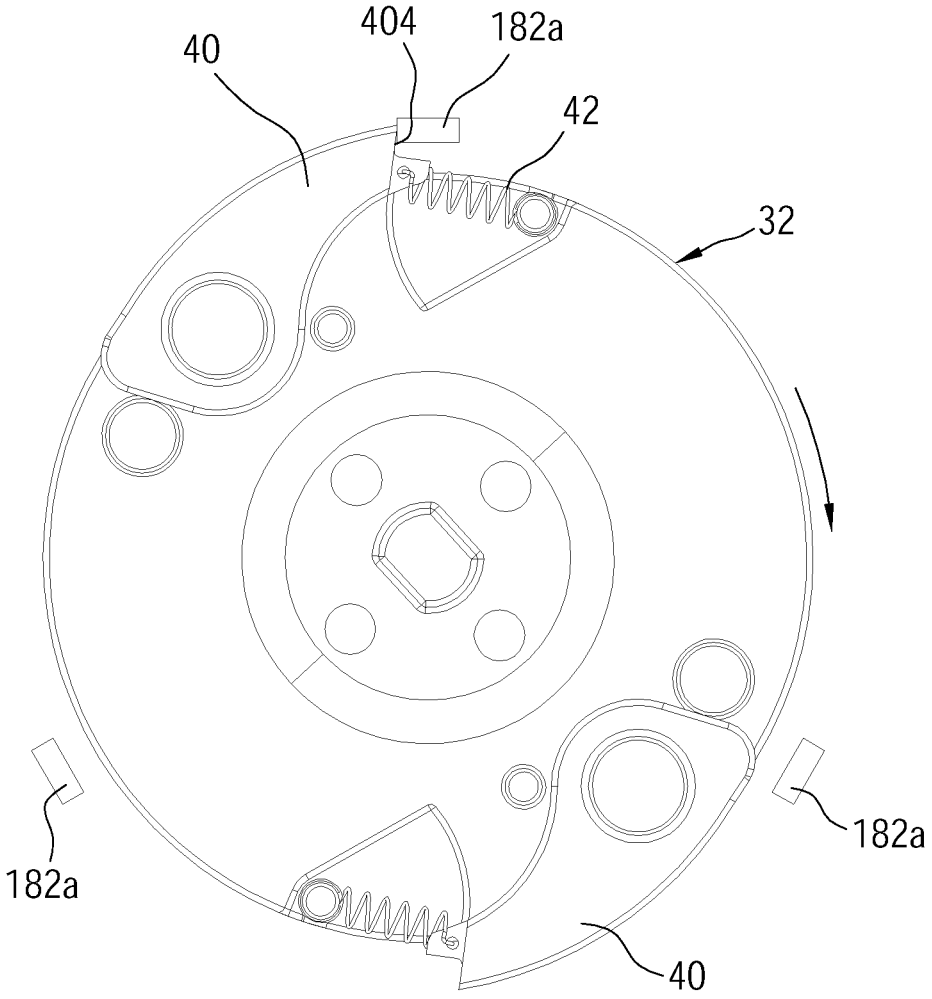
FIG. 10 is a schematic diagram disclosing that the braking part is abutting against the blocking part at the braking position.
Figure 11:
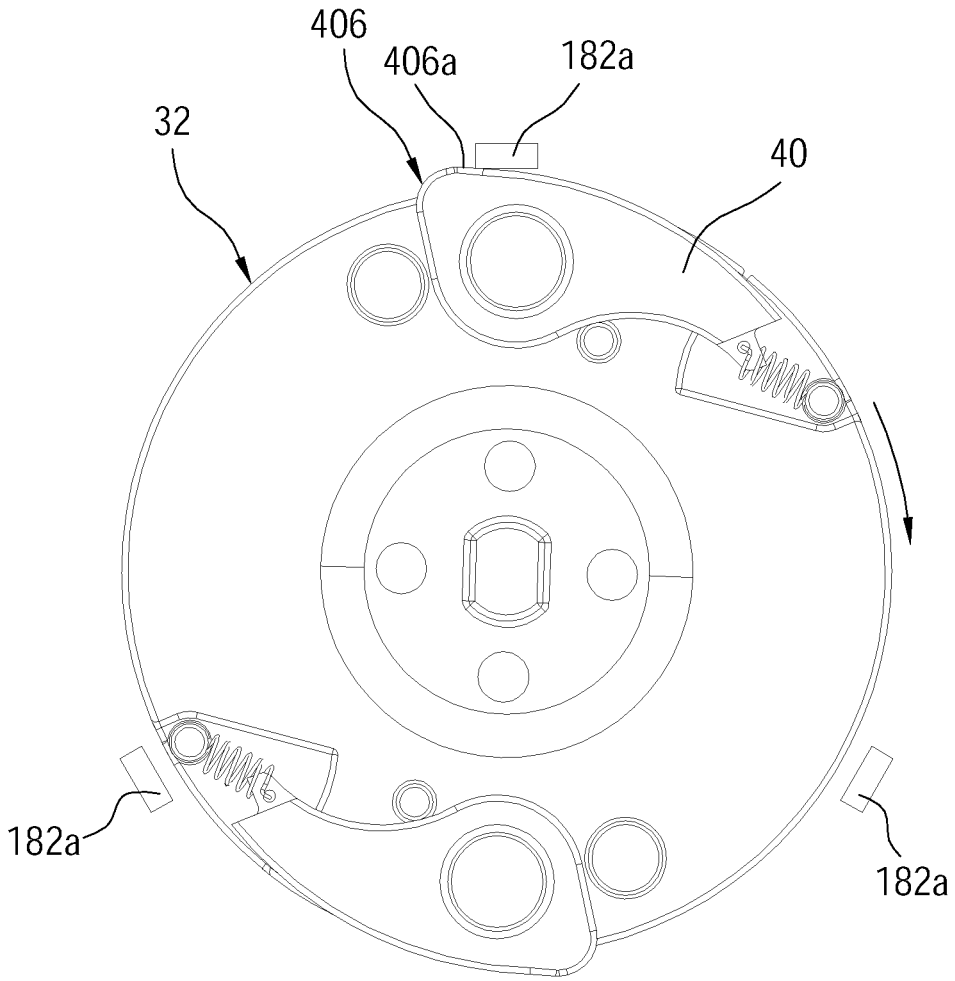
FIG. 11 is a schematic diagram disclosing that the braking part is located at the non-braking position and passes by the blocking part.

In the current embodiment, the at least one braking part 40 includes two braking parts 40, and each of the braking parts 40 has a pivoting hole 402, wherein an inner width of the pivoting hole 402 is greater than the width of the pivot 36 on the braking plate 32. The braking part 40 is pivotally engaged to the pivot 36 on the inner side surface 322 of the braking plate 32 by the pivoting hole 402, so that the braking part 40 is located in a room between the inner side surface 322 of the braking plate 32 and the outer side surface 182 of the first side plate 18. The pivoting hole 402 of the braking part 40 is in a loose fit manner with the pivot 36 to prevent the pivot 36 from getting stuck because of dust getting in a pivoting part between the pivot 36 and the pivoting hole 402. The braking part 40 could pivot between a braking position (shown in FIG. 10) and a non-braking position (shown in FIG. 11), and each of two braking parts 40 has a blocking portion 404. The blocking portion 404 of the braking part 40 would be spun outward due to a centrifugal force, which is formed by the rolling braking plate 32 and is located at the braking position to be abutting against the blocking part 182*a*, so that limits the rotation of the rolling member 24.

The restoring spring 42 is connected between the braking part 40 and the braking plate 32 and is adapted to force the braking part 40 to move toward the non-braking position, so that the blocking portion 404 of the braking part 40 is ordinarily located within the outer circumference of the braking plate 32. The at least one restoring spring 42 includes two restoring springs 42 in the current embodiment, and an end of each of two restoring springs 42 is connected to each of two braking parts 40 and is located beside the blocking portion 404. Another end of each of two restoring springs 42 has a ring 422, which is fitted around the fixing pillar 38, and each of the rings 422 is located between the surface 324 and each of the depression-surface 326*a* (shown in FIG. 7), so that forces each of the restoring springs 42 to get close to the surface 324 of the braking plate 32 and also forces each of the braking parts 40 to get close to the surface 324 of the braking plate 32. Each of the restoring springs 42 has a body part 424 adapted to form an elasticity, wherein a portion of the body part 424 extends in the depression 326, and as the braking part 40 is located at non-braking position, the restoring spring 42 is located within an orthographic range of the depression 326. In this way, the depression 326 could receive the portion of the body part 424, so that avoids the restoring spring 42 holding the braking part 40 and keeping the braking part 40 away from the surface 324 which results in the braking part 40 rubbing against the first side plate 18.

When the user falls accidentally, forcing the safety belt 26 to be pulled out rapidly then drives the rolling member 24 and the braking plate 32 to rotate quickly, so that the braking part 40 would be forced under the centrifugal force and would overcome the elasticity of the restoring spring 42 to be spun outward. Further, one of the braking parts 40 abuts against one of the blocking parts 182*a* to limit the rotation of the rolling member 24, and to fix the length that the safety belt 26 is pulled out. Thereafter, the aim is achieved to prevent the user from falling continuously.

Figure 5:
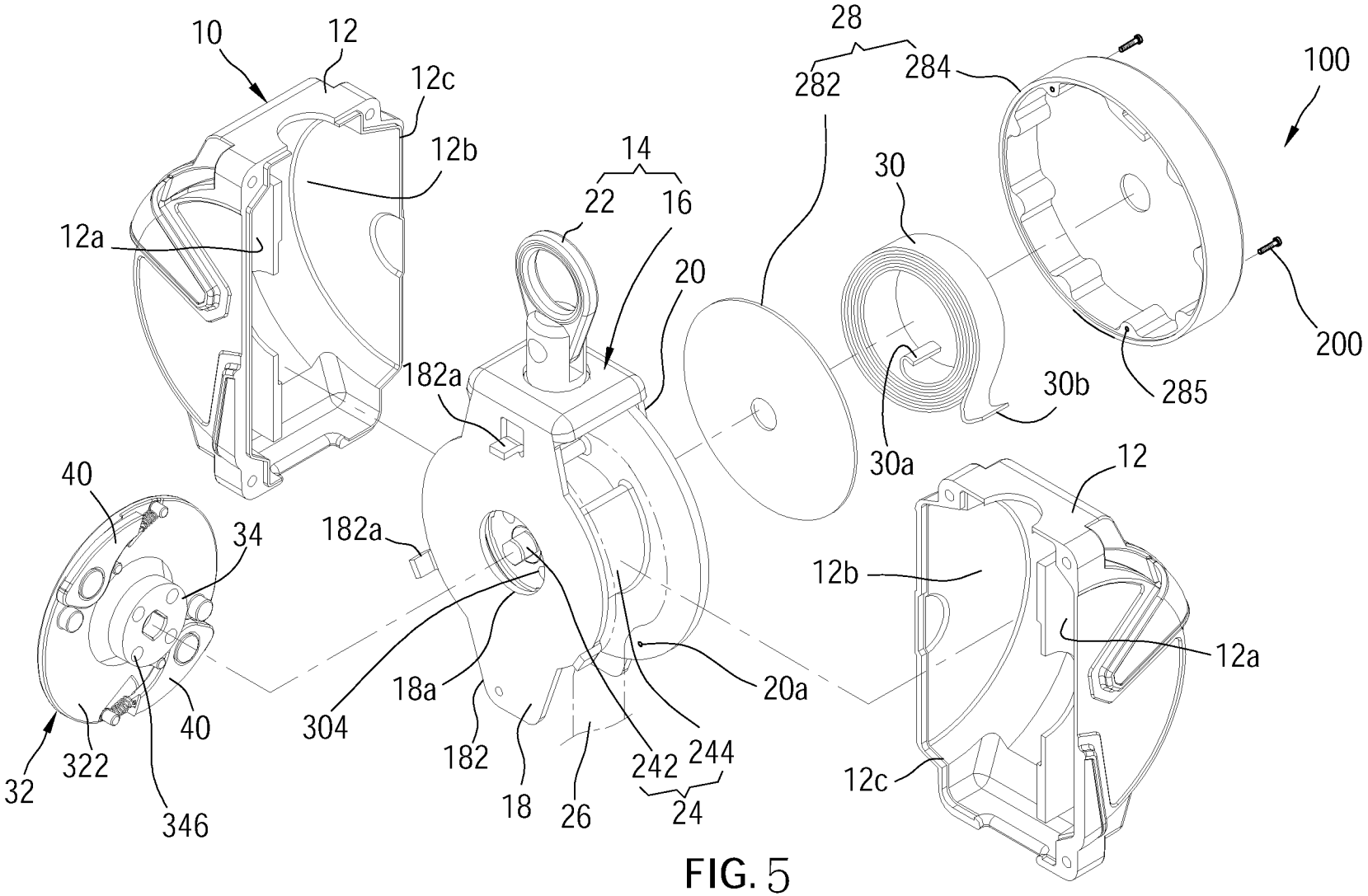
FIG. 5 is an exploded view of the fall protection device according to the embodiment shown in FIG. 4.
Figure 6:
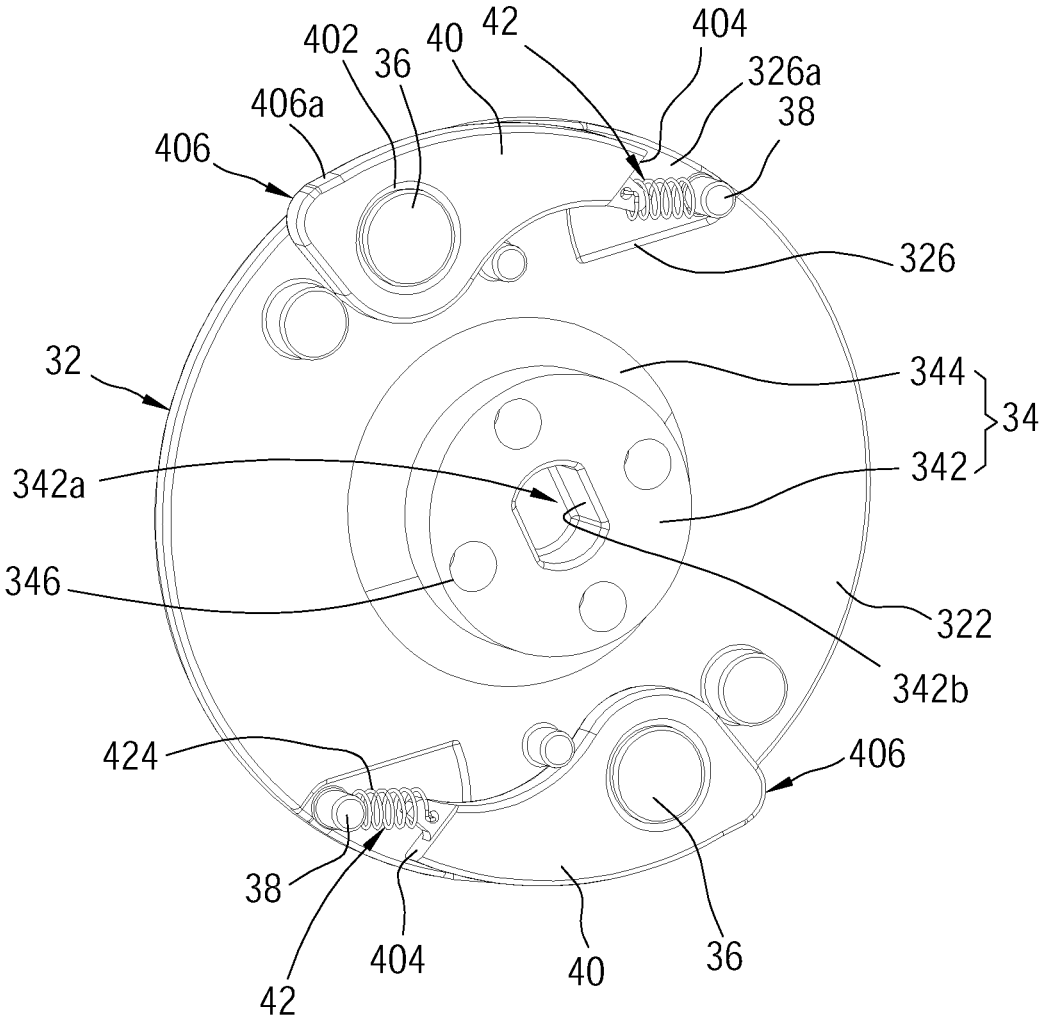
FIG. 6 is a perspective view of the braking plate and the braking part according to the embodiment shown in FIG. 4.
Figure 7:
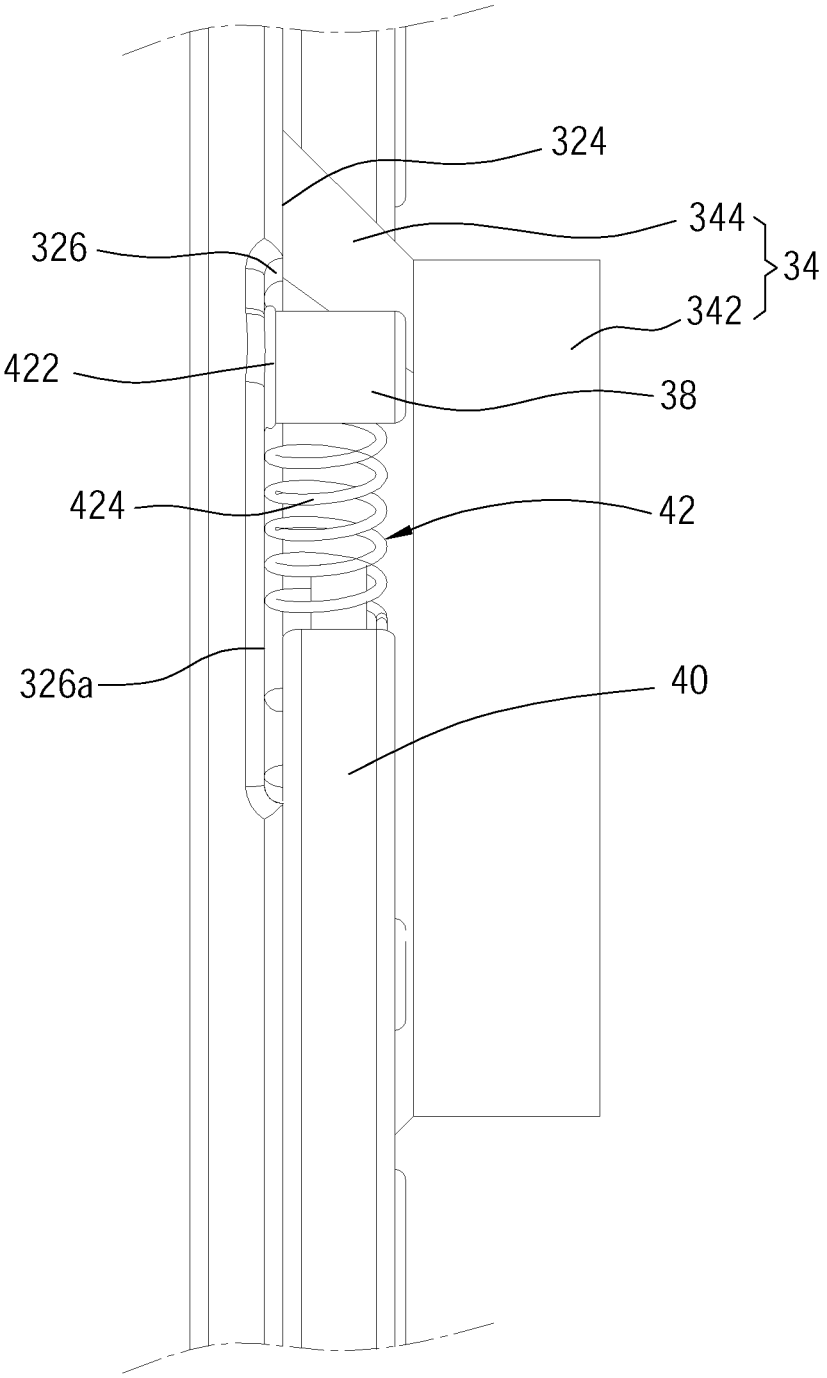
FIG. 7 is a side view of a part of the fall protection device, which is shown in FIG. 5.
Figure 8:
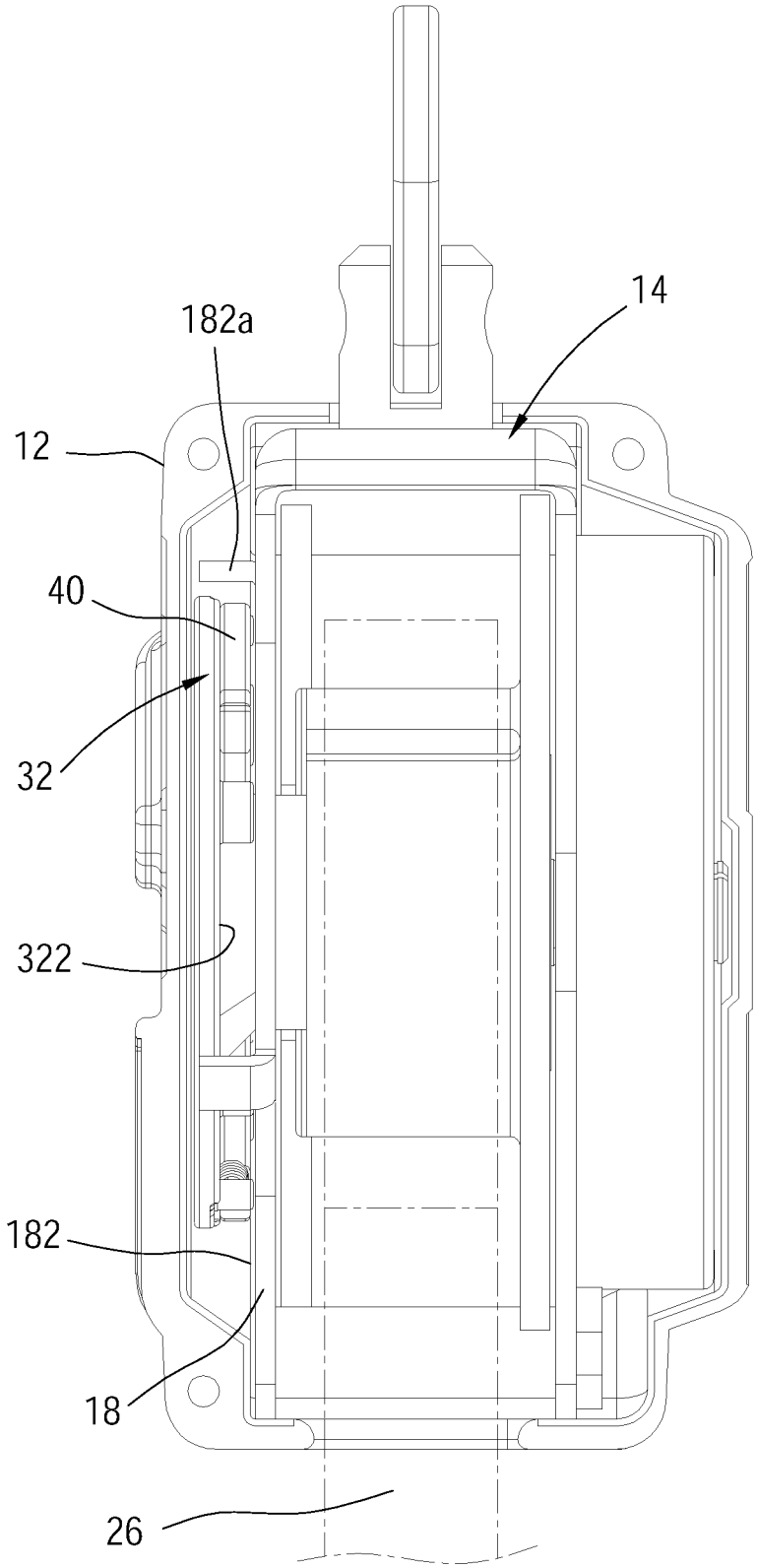
FIG. 8 is a side view of the fall protection device, which is without one of the housing bodies.
Figure 9:
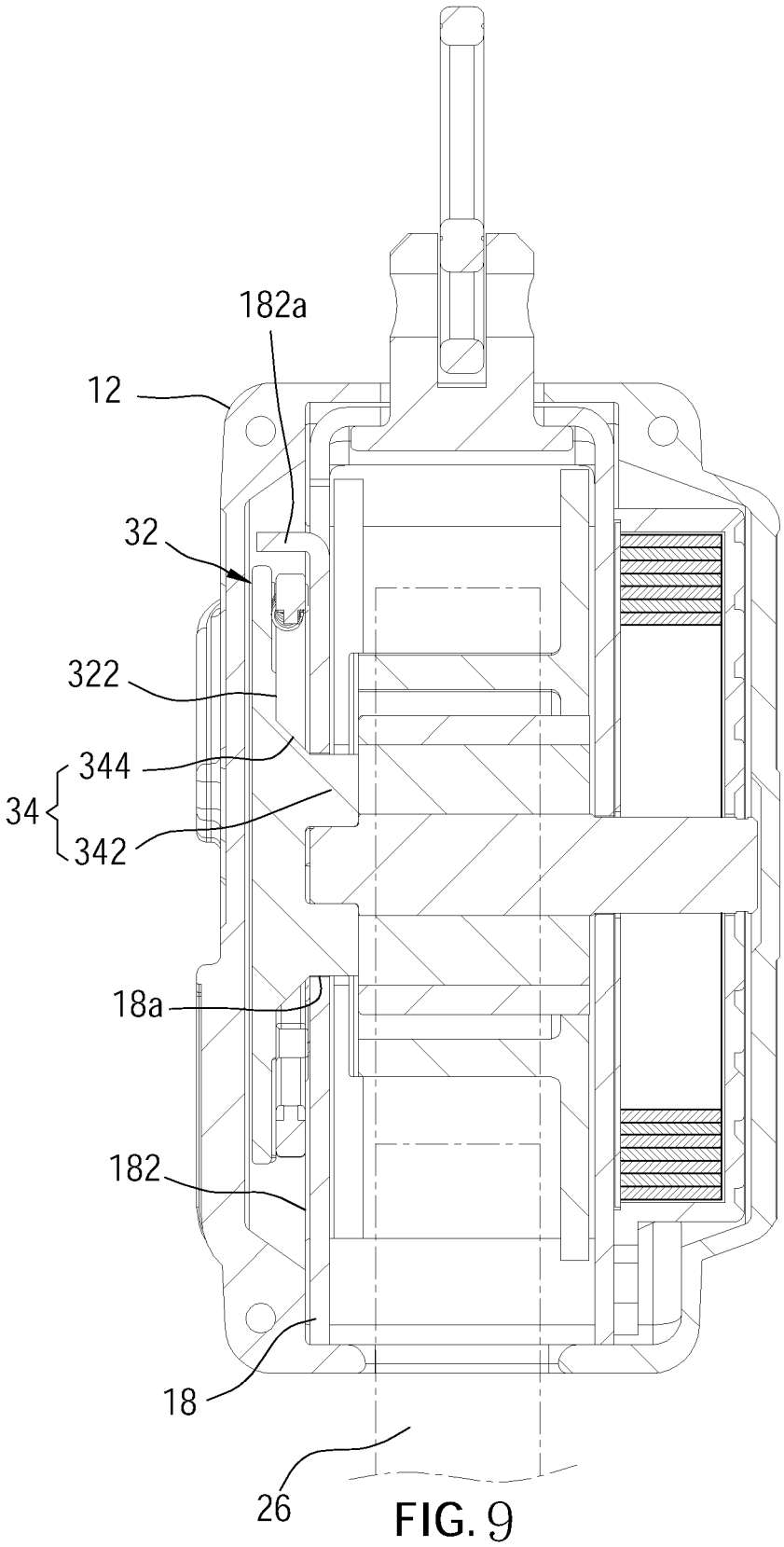
FIG. 9 is a sectional view of the fall protection device, which is shown in FIG. 8.
Figure 13:
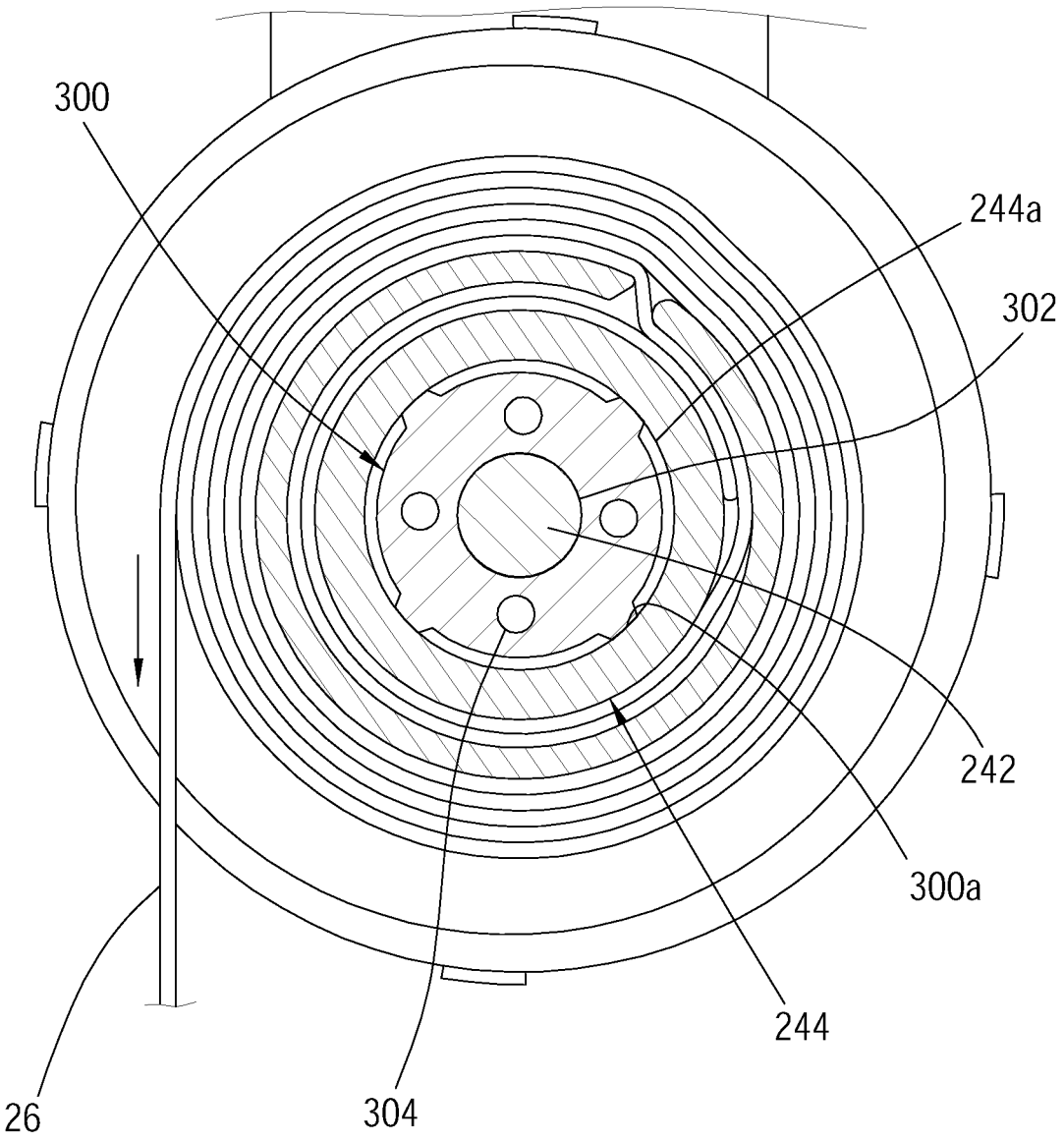
FIG. 13 is a schematic diagram disclosing the relationship among the decelerating member, the rolling drum and the safety belt.

Additionally, referring to FIG. 5 and FIG. 13, in an embodiment the preferred fall protection device 100 further includes a decelerating member 300, wherein the decelerating member 300 is fitted around the shaft 242 and is located between the shaft 242 and the rolling drum 244. An outer peripheral of the decelerating member 300 has at least one friction surface 300*a* being in contact with an inner peripheral surface 244*a* of the rolling drum 244. In the current embodiment, the decelerating member 300 has a plurality of friction surfaces 300*a* set at intervals, and the decelerating member 300 also has a perforation 302 and a plurality of positioning holes 304, wherein the perforation 302 is adapted to be disposed with and be passed through by the shaft 242. The plurality of positioning holes 304 is located at a site corresponding to the site of the plurality of positioning holes 346 on the braking plate 32. In this way, the user could use a plurality of positioning members (i.e., a bolt) to pass through the positioning hole 304 and the positioning hole 346 respectively and fix them together, so that the braking plate 32 and the decelerating member 300 could rotate synchronically.

In this way, when the braking part 40 spin outward and is abutting against the blocking part 182*a*, the braking plate 32 is fixed. The shaft 242 and the decelerating member 300, which are both connected to the braking plate 32, would also be fixed. In the meantime, the rolling drum 244 would still rotate due to the safety belt 26 pulled out by a force. Because the inner peripheral surface 244*a* of the rolling drum 244 is in conjunction with the fixed friction surface 300*a* of the decelerating member 300, as the rolling drum 244 rotates relatively to the decelerating member 300, the friction surface 300*a* of the decelerating member 300 would rub the inner peripheral surface 244*a* of the rolling drum 244 and would form a rolling friction force, so that the speed of the moving rolling drum 244 is limited and is slow down. The aim that cushions the speed of the safety belt 26 and slows down the speed of the user or an object connected to the safety belt 26 is achieved.

Furthermore, with the design of the shaft 242, the braking plate 32 and the decelerating member 300, which are all rotate coaxially and synchronously, when the braking part 40 abuts against the blocking part 182*a* to force the fall protection device 100 to be locked immediately, the shaft 242 is fixed, and the cover body 28 is also fixed on the second side plate 20, so both of the inner end 30*a* and the outer end 30*b* of the spiral spring 30 would not be overstretched by the force. It would not happen that the spiral spring 30 is broken or elastically fatigued due to overstretching. Hence, even the fall protection device 100 has been locked for many times, the spiral spring 30 could still work normally.

It is also worth mentioning that the first side plate 18 and the braking plate 32 restrict the movement of the braking part 40 to ensure that as the braking part 40 is at the braking position, the blocking portion 404 could abut against the blocking part 182*a*, instead of missing and failing to abut against the blocking part 182*a* due to the braking part pivoting backward that happened in the conventional fall protection device.

Figure 12:
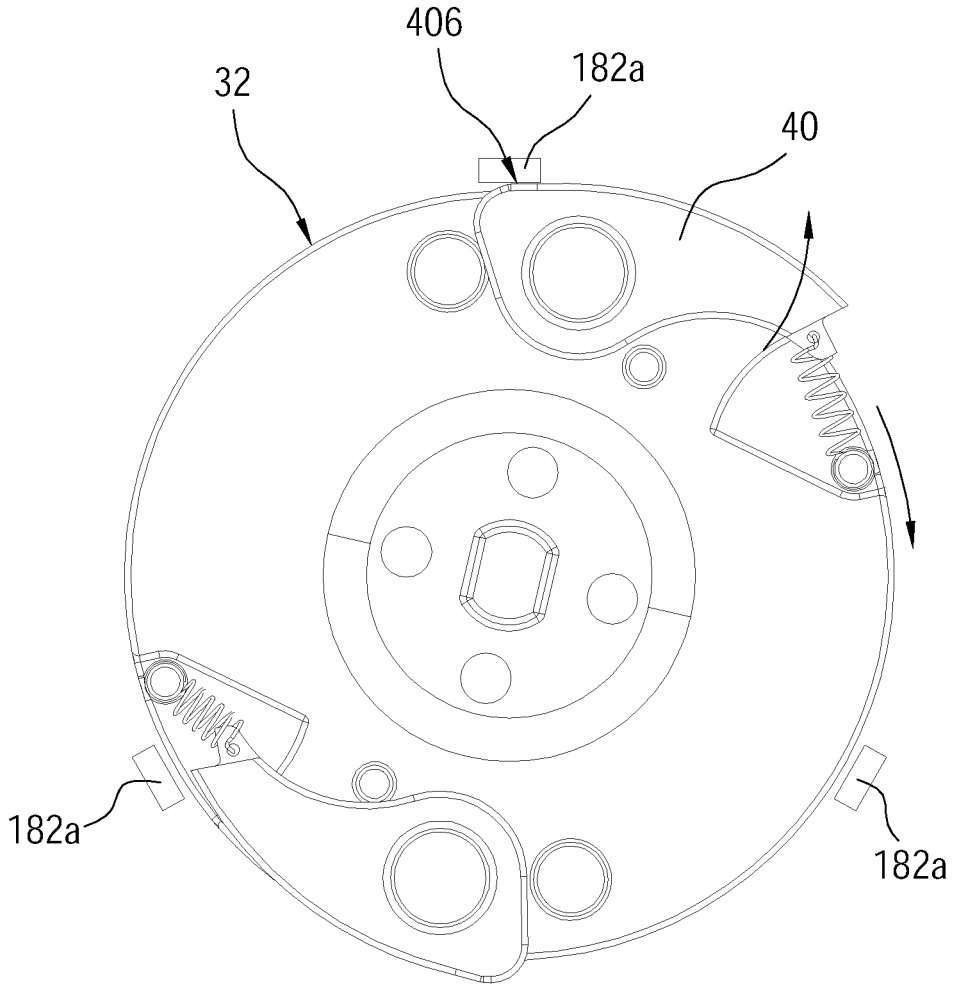
FIG. 12 is a schematic diagram disclosing that the propped portion of the braking part is propped by the blocking part and is pivoted out.

In order to prevent a pivoting site, where the braking part 40 is pivotally engaged to the braking plate 32, from being attached by dust inducing that each of the braking parts 40 could not pivot outward and results in an accident, so the present invention further makes a special design to the structure of the braking part 40. There would take an example and describe as following:

The braking part 40 further has a propped portion 406. The propped portion 406 and the blocking portion 404 are located at respectively two sides of the pivoting hole 402, which are opposite to each other. The propped portion 406 is driven to move along a moving pathway by the rotating braking plate 32, and the blocking part 182*a* is located on the moving pathway of the propped portion 406. In the current embodiment, an edge 406*a* of the propped portion 406 deviates from the direction toward the pivoting hole 402 and protrudes out of a circumference of the braking plate 32. Whenever the propped portion 406 passes by the blocking part 182*a* and is propped by the blocking part 182*a*, the braking part 40 would pivot outward (shown in FIG. 12) from the non-braking position (shown in FIG. 11).

In this way, the user could pull the safety belt 26 to ensure that the braking part 40 is not stuck because of the vibration produced by the pivoted braking part 40, and to be certain that the fall protection device 100 could work normally. It is also worth mentioning that if the braking part 40 is stuck and is unable to be pivoted, then the propped portion 766 of the braking part 40 would be engaged to the blocking part 182*a* and restrict the rolling movement of the rolling member 24, and it further prevents the user from continuously falling, so that the fall protection device 100 has a double protection effect.

It must be pointed out that the embodiments described above are only some embodiments of the present invention. All equivalent structures which employ the concepts disclosed in this specification and the appended claims should fall within the scope of the present invention.

What is claimed is:

1. A fall protection device, comprising:

a frame including a first side plate and a second side plate facing to the first side plate, wherein the first side plate has an outer side surface that does not face the second side plate, and the outer side surface is disposed with a blocking part;

a rolling member rotatably disposed between the first side plate and the second side plate and including a shaft and a rolling drum, wherein the rolling drum is provided on the shaft, wherein the shaft synchronously rotates with the rolling drum;

a safety belt wound around the rolling drum of the rolling member and located between the first side plate and the second side plate, wherein the safety belt is pulled and forces the rolling member to rotate;

a braking plate engaged to the rolling member and including an inner side surface facing the outer side surface of the first side plate, and the braking plate coaxially rotating with the shaft;

a braking part pivotally disposed on the inner side surface of the braking plate and located between the inner side surface of the braking plate and the outer side surface of the first side plate; the braking part including a blocking portion, wherein the blocking portion of the braking part is pivoted outward to a braking position from a non-braking position to attach the blocking part due to a centrifugal force produced by a rotation of the braking plate to restrict the rotation of the rolling member; and a restoring spring connected between the braking part and the braking plate and adapted to force the braking part to move toward the non-braking position;

wherein the inner side surface of the braking plate is disposed with a fixing pillar, and an end of the restoring spring is connected to the braking part and is located beside the blocking portion, while another end includes a ring fitted around the fixing pillar; and wherein the inner side surface has a depression; the restoring spring has a body part, and a portion of the body part protrudes into the depression.

2. The fall protection device as claimed in claim 1, wherein the inner side surface of the braking plate is provided with a pivot, and the braking part has a pivoting hole fitted around the pivot; a width of the pivot is less than a width of the pivoting hole.

3. The fall protection device as claimed in claim 1, wherein the inner side surface has a surface, and the depression is formed by recessed the surface; an end of the fixing pillar is connected to a depression-surface of the depression; the ring of the restoring spring is located between the surface and the depression-surface.

4. The fall protection device as claimed in claim 3, wherein as the braking part is at the non-braking position, the restoring spring is located within an orthographic range of the depression.

5. The fall protection device as claimed in claim 1, wherein the first side plate of the frame has a perforation; the inner side surface of the braking plate is provided with a protruding portion, and the protruding portion includes a first part and a second part connected with the first part; the first part passes through the perforation of the first side plate and is connected to the rolling member, and a width of the second part is gradually expanding from the first part to the inner side surface.

6. The fall protection device as claimed in claim 2, wherein the braking part has a propped portion; the propped portion and the blocking portion are respectively located at two sides of the pivoting hole, and two sides thereof are opposite to each other; the propped portion follows the rotation of the braking plate to move along a moving pathway; the blocking part is located at the moving pathway of the propped portion; when the propped portion passes by the blocking part and is propped by the blocking part that forces the braking part to be pivoted.

7. The fall protection device as claimed in claim 6, wherein the braking plate has an outer circumference; an edge of the propped portion is oriented away from a direction toward the pivoting hole, and protrudes out of the outer circumference; when the propped portion passes by the blocking part, the edge passes and is abutting against the blocking part.

8. A fall protection device, comprising:

a frame including a first side plate and a second side plate facing to the first side plate, wherein the first side plate has an outer side surface that does not face the second side plate, and the outer side surface is disposed with a blocking part;

a rolling member rotatably disposed between the first side plate and the second side plate and including a shaft and a rolling drum, wherein the rolling drum is provided on the shaft, wherein the shaft simultaneously rotates with the rolling drum;

a safety belt wound around the rolling drum of the rolling member and located between the first side plate and the second side plate, wherein the safety belt is pulled and forces the rolling member to rotate;

a braking plate engaged to the rolling member and including an inner side surface facing the outer side surface of the first side plate, and the braking plate coaxially rotating with the shaft;

a braking part pivotally disposed on the inner side surface of the braking plate and located between the inner side surface of the braking plate and the outer side surface of the first side plate; the braking part including a blocking portion, wherein the blocking portion of the braking part is pivoted outward to a braking position from a non-braking position to attach the blocking part due to a centrifugal force produced by rotation of the braking plate to restrict the rotation of the rolling member; and a restoring spring connected between the braking part and the braking plate and adapted to force the braking part to move toward the non-braking position, wherein the restoring spring has a body part and two end portions; the two end portions of the restoring spring are respectively connected to the braking part and the braking plate;

wherein the inner side surface of the braking plate has a depression, and a portion of the body part of the restoring spring protrudes into the depression.

* * * * *